United States Patent [19]

Hendricks et al.

[11] 4,276,046

[45] Jun. 30, 1981

[54] PROCESS FOR DYEING POLYESTER FIBRES OF FIBRE MIXTURES CONTAINING THEM

[75] Inventors: Udo-Winfried Hendricks, Odenthal-Voiswinkel; Karlhans Jakobs, Bergisch-Gladbach, both of Fed. Rep. of Germany

[73] Assignee: Bayer Aktiengesellschaft, Leverkusen, Fed. Rep. of Germany

[21] Appl. No.: 39,126

[22] Filed: May 15, 1979

[30] Foreign Application Priority Data

May 17, 1978 [DE] Fed. Rep. of Germany ..... 2821494

[51] Int. Cl.[3] ..... D06P 1/613; D06P 1/667; D06P 3/36

[52] U.S. Cl. ..... 8/532; 8/533; 8/580; 8/582; 8/584

[58] Field of Search ..... 8/169, 86, 21 C, 582, 8/580, 584, 532, 533

[56] References Cited

U.S. PATENT DOCUMENTS

| | | | |
|---|---|---|---|
| 2,020,517 | 12/1935 | Rewald | 8/86 |
| 3,830,627 | 4/1974 | Daeuble et al. | 8/169 |
| 3,844,771 | 10/1974 | Daeuble et al. | 8/169 |
| 3,951,598 | 4/1976 | Arashi et al. | 8/169 |
| 3,963,432 | 6/1976 | Hauxwell et al. | 8/169 |
| 3,967,924 | 7/1976 | Hobday et al. | 8/169 |
| 4,055,393 | 10/1977 | Schafer et al. | 8/21 C |

OTHER PUBLICATIONS

Chem. Abstracts, vol. 86, 1414716, 1977.

*Primary Examiner*—Joseph L. Schofer

*Assistant Examiner*—Maria Parrish Tungol

*Attorney, Agent, or Firm*—Sprung, Felfe, Horn, Lynch & Kramer

[57] ABSTRACT

An aqueous formulation which contains (a) 10–50% of lecithin, (b) 5–40% of an oxyethylated carboxylic acid of the general formula $$R—CO—O—(CH_2—CH_2—O—)_nH$$

I in which

R represents a saturated or unsaturated alkyl radical with 11–21 carbon atoms and n represents a number between 4 and 12, (c) 5–40% of an oxyethylated alcohol of the general formula $$R'—O—(CH_2—CH_2—O—)_mH$$

II in which

R′ represents a saturated or unsaturated alkyl radical with 12–20 carbon atoms and m represents a number between 10 and 30, and (d) 0–20% of an alkanol with 1–3 carbon atoms, of a glycol with 2–4 carbon atoms or alkyl ethers thereof with 1–4 carbon atoms, or of diethylene glycol, triethylene glycol or tetraethylene glycol or alkyl ethers thereof with 1–4 carbon atoms, is used for dyeing woven goods and knitted goods of polyester fibres or fibre mixtures containing polyester fibres with disperse dyestuffs in an aqueous liquor at temperatures of 95°–140° C.

3 Claims, No Drawings

PROCESS FOR DYEING POLYESTER FIBRES OF FIBRE MIXTURES CONTAINING THEM

The invention relates to a process for dyeing woven goods and knitted goods of polyester fibres or fibre mixtures containing polyester fibres with disperse dyestuffs in an aqueous liquor at temperatures of 95°–140° C., characterised in that an aqueous formulation which contains (a) 10–50% of lecithin, (b) 5–40% of an oxyethylated carboxylic acid of the general formula $$R—CO—O—(CH_2—CH_2—O—)_nH \quad \text{I}$$

in which

R represents a saturated or unsaturated alkyl radical with 11–21 carbon atoms and n represents a number between 4 and 12, (c) 5–40% of an oxyethylated alcohol of the general formula $$R'—O—(CH_2—CH_2—O—)_mH \quad \text{II}$$

in which

R' represents a saturated or unsaturated alkyl radical with 12–20 carbon atoms and m represents a number between 10 and 30, and (d) 0–20% of an alkanol with 1–3 carbon atoms, of a glycol with 2–4 carbon atoms or alkyl ethers thereof with 1–4 carbon atoms, or of diethylene glycol, triethylene glycol or tetraethylene glycol or alkyl ethers thereof with 1–4 carbon atoms, is used.

Lecithins which can be used are the known products isolated from animal or vegetable organisms, in particular soya lecithin.

Examples of oxyethylated carboxylic acids of the general formula I which may be mentioned are oxyethylated palmitic acid, stearic acid and behenic acid and, in particular, oxyethylated unsaturated acids, such as oxyethylated oleic acid, linoleic acid and linolenic acid.

Examples of oxyethylated alcohols of the formula II are oxyethylated palmityl alcohol or stearyl alcohol and, in particular, oxyethylated oleyl alcohol.

Suitable alcohols in group (d) are methanol, ethanol and, in particular, isopropanol.

Examples of polyester fibres which may be mentioned are those of polyethylene glycol terephthalate, poly-1,4-bis(hydroxymethyl)-cyclohexane terephthalate and poly-p-hydroxyethoxy-benzoate; examples of possible fibre mixtures containing polyester fibres are polyester/wool mixtures, polyester/viscose staple mixtures or polyester/cotton mixtures.

The invention also relates to auxiliaries which contain aqueous formulations of components a–d.

The amounts in which the formulation according to the invention is employed can vary within wide limits. Suitable amounts can be determined by preliminary experiments; in general, additions of 0.3–6 g per liter of dye liquor have proved suitable.

In addition to the dyestuffs suitable for the dyeing and the abovementioned formulations, the dyebaths can also contain commercially available carriers, salts, such as, for example, sodium acetate, and acids, such as acetic acid or sulphuric acid. Dyeing of the fibre materials can be effected by customary processes in open or closed dyeing apparatus, at 90°–110° C. in accordance with the exhaustion process or, in particular, under high temperature conditions (120°–140° C.).

Up to a few years ago, woven goods and knitted goods of polyester fibres or of fibre mixtures containing polyester fibre were dyed on open winch vats at the boiling point, carriers being added. As a result of developments in machine technology, today it is possible to dye such articles in hermetically sealed dyeing apparatus at elevated temperatures. The not inconsiderable costs of carriers are thereby reduced or completely spared.

The woven goods and knitted goods to be dyed run in rope form on the abovementioned closed dyeing apparatus. As a result of this, and also because of the relatively high dyeing temperature, they are particularly susceptible to fold and crease formation. In practice, softeners and anti-crease agent are thus frequently employed in dyeing these articles, in order to largely avoid fold and crease formation. The softeners and anti-crease agents must be stable at the relatively high dyeing temperature; furthermore, they should not impair the stability of the dyestuff dispersion.

Furthermore, it is advisable to also use a levelling auxiliary when dyeing polyester fibres under high temperature conditions. The customary levelling auxiliaries are oxyethylation products which have the property of foaming on vigorous agitation of the liquor. Severe foam formation can lead to difficulties when dyeing piece goods in rope form, by the goods snarling and being caught in the goods guides. This causes the goods to stop and they become unlevel.

The formulations according to the invention fulfil, to a great extent, the high requirements to be made in the case of dyeing woven goods and knitted goods of polyester fibres or of blended yarns containing polyester fibres; they are distinguished by freedom from foaming and a good levelling action, they increase the stability of the dispersion and they avoid fold and crease formation.

EXAMPLE 1

A woven fabric, the warp and weft of which consists of a blended yarn of 55 parts of polyester fibre and 45 parts of wool, is dyed on a jet-dyeing apparatus in a liquor ratio of 1:20. As well as the dyestuffs customary for dyeing the polyester fibre and wool, the liquor contains the following additives: 0.2 g/l of soya lecithin, 0.1 g/l of oleic acid hexaglycol ester, 0.1 g/l of oleyl polyglycol ether oxyethylated with 20 mols of ethylene oxide, 2 g/l of a commercially available carrier and the acetic acid necessary to adjust the acidity of the liquor. Dyeing is started at 60° C. After a brief initial period, the temperature of the dyebath is brought to 106° C. in the course of 60 minutes and kept at this temperature for 45–60 minutes. In spite of intensive agitation of the liquor, no foam is formed during dyeing. When dyeing has ended, the dyebath is cooled and the fabric is rinsed, drained and dried. A uniformly dyed fabric which is free from folds and creases is obtained.

Similarly good results are achieved if oleic acid octaglycol ester or decaglycol ester or linoleic acid hexaglycol ester, octaglycol ester or decaglycol ester is used instead of oleic acid hexaglycol ester.

The reaction products of palmityl alcohol and 15 mols of ethylene oxide, of stearyl alcohol and 30 mols of ethylene oxide and of oleyl alcohol and 30 mols of ethylene oxide can be employed successfully instead of the reaction product of oleyl polyglycol ether and 20 mols of ethylene oxide.

EXAMPLE 2

A knitted fabric of a texturised polyester fibre is dyed on an incompletely flooded jet-dyeing apparatus in a liquor ratio of 1:15. As well as the disperse dyestuffs customary for dyeing, the liquor contains 0.25 g/l of soya lecithin, 0.12 g/l of oleic acid hexaglycol ester, 0.12 g/l of oleyl polyglycol ether oxyethylated with 20 mols of ethylene oxide, 2 g/l of sodium dihydrogen phosphate and the amount of acetic acid required for adjusting the acidity of the liquor. Dyeing is started at 70° C. After a brief initial period, the temperature of the bath is increased to 125° C. in the course of 30 minutes. During dyeing, which is carried out at 125° C. for 30 minutes, the fabric passes through the dyeing machine unhindered. It can be seen, through inspection windows, that the liquor leaving through the jets contains no foam at all. When dyeing has ended, the bath is cooled to below 100° C. The fabric is then rinsed, drained and dried. It is uniformly dyed and has no folds or creases.

We claim:

1. Process for dyeing woven goods and knitted goods of polyester fibres or fibre mixtures containing polyester fibres with disperse dyestuffs in an aqueous liquor at temperatures of 95°-140° C., wherein an aqueous formulation which contains (a) 10-50% of lecithin, (b) 5-40% of an oxyethylated carboxylic acid of the general formula $$R—CO—O—(CH_2—CH_2—O—)_nH$$

in which

R represents a saturated or unsaturated alkyl radical with 11-21 carbon atoms and n represents a number between 4 and 12, (c) 5-40% of an oxyethylated alcohol of the general formula $$R'—O—(CH_2—CH_2—O—)_mH$$

in which

R' represents a saturated or unsaturated alkyl radical with 12-20 carbon atoms and m represents a number between 10 and 30, and (d) 0-20% of an alkanol with 1-3 carbon atoms, of a glycol with 2-4 carbon atoms or alkyl ethers thereof with 1-4 carbon atoms, or of diethylene glycol, triethylene glycol or tetraethylene glycol or alkyl ethers thereof with 1-4 carbon atoms, is used.

2. Process according to claim 1, wherein an aqueous formulation of (a) 10-50% of lecithin, (b) 5-40% of an oxyethylated carboxylic acid of the general formula $$R—CO—O—(CH_2—CH_2—O—)_nH$$

in which

R represents a monounsaturated alkyl radical with 15-17 carbon atoms and n represents a number between 4 and 8, (c) 5-40% of an oxyethylated alcohol of the general formula $$R'—O—(CH_2—CH_2—O—)_mH$$

in which

R' represents a monounsaturated alkyl radical with 16-18 carbon atoms and m represents a number between 15 and 25, and (d) 5-15% of an alkanol with 1-3 carbon atoms or of a $C_1$-$C_4$-ether or diethylene glycol, triethylene glycol or tetraethylene glycol, is used.

3. Auxiliaries for dyeing polyester fibres or fibre mixtures containing them, wherein said auxiliaries contain (a) 10-50% of lecithin, (b) 5-40% of an oxyethylated carboxylic acid of the general formula $$R—CO—O—(CH_2—CH_2—O—)_nH$$

in which

R represents a saturated or unsaturated alkyl radical with 11-21 carbon atoms and n represents a number between 4 and 12, (c) 5-40% of an oxyethylated alcohol of the general formula $$R'—O—(CH_2—CH_2—O—)_mH$$

in which

R' represents a saturated or unsaturated alkyl radical with 12-20 carbon atoms and m represents a number between 10 and 30, (d) 0-20% of an alkanol with 1-3 carbon atoms, of a glycol with 2-4 carbon atoms or alkyl ethers thereof with 1 to 4 carbon atoms, or of diethylene glycol, triethylene glycol or tetraethylene glycol or alkyl ethers thereof with 1-4 carbon atoms and (e) water.

* * * * *